United States Patent [19]

Trifiletti

[11] 4,037,581

[45] July 26, 1977

[54] SCREEN DEVICE FOR STOVE OVENS

[75] Inventor: Thomas Trifiletti, Albany, N.Y.

[73] Assignees: Lucia F. Friese; Mary A. Krauss; Lewis Trifiletti, all of Albany, N.Y.; part interest to each

[21] Appl. No.: 689,688

[22] Filed: May 25, 1976

[51] Int. Cl.[2] ..... A21B 1/42

[52] U.S. Cl. ..... 126/39 M; 126/214 D; 126/299 C

[58] Field of Search ..... 126/299 C, 214 D, 218, 126/202, 39 M

[56] References Cited

U.S. PATENT DOCUMENTS

| | | | |
|---|---|---|---|
| 2,248,198 | 7/1941 | Ratz | 126/299 C |
| 2,565,905 | 8/1951 | Belau | 126/299 C |
| 2,887,154 | 5/1959 | Morningstar et al. | 126/299 C |

*Primary Examiner*—Edward G. Favors

*Attorney, Agent, or Firm*—Frederick L. Bergert

[57] ABSTRACT

A screen device for use in preventing grease from splattering within a stove oven while broiling food is disclosed. The screen device includes means for adjusting the height of the screen above an oven rack upon which the screen may be placed. In addition, the screen is provided with leg members which allow the screen to be attached directly to the broiler coils of an electric oven. The present invention is particularly constructed to prevent grease from splattering up to the flame or broiler coils of the oven.

3 Claims, 3 Drawing Figures

SCREEN DEVICE FOR STOVE OVENS

BACKGROUND AND SUMMARY OF THE INVENTION

The present invention is related to a screen device for use in stove ovens. More particularly, the present invention is related to a screen device which is designed to prevent grease from splattering within a stove oven while broiling food.

Heretofore there has not been available a screen device which is easily adjustable for use in a stove oven in order to prevent grease from splattering up to the flame or broiler coils of the oven as is often the case when broiling food. Furthermore, no such device has been available which may be attached to the broiler coils of electric stoves in order to have the screen in an out-of-the way location and yet being effective to prevent grease from splattering on the coils during broiling.

By the present invention, there is provided a device for use in stove ovens which is effective to prevent grease from splattering during broiler operations, so that such grease does not splatter on the flame or broiler coils within the oven. By the use of the present invention, the risk of fire or personal injury during such broiler operations is substantially reduced. In addition, improved results may be obtained when broiling food, since the food may be placed closer to the flame or coils without getting a splatter.

The screen device of the present invention includes a screen, of metal or other durable and heat resistant material, having a suitable frame secured around the periphery thereof and with pivotable legs on the outer portion thereof in order to provide easy adjustment of the height of the screen when the screen is located on a tray or rack within the oven. Furthermore, the legs of the present screen device are provided with a curve on the bottom or extreme end portion thereof, so that the device may be inverted and attached directly to the broiler coils of electric ovens, thus minimizing the space required for the device which prevents food or grease from splattering on said coils.

BRIEF DESCRIPTION OF THE DRAWINGS

The advantages and features of the screen device for stove ovens of the present invention will be more fully understood from the following description of the preferred embodiments, taken in conjunction with the accompanying drawings, wherein.

DESCRIPTION OF THE PREFERRED EMBODIMENTS

Figure 1:
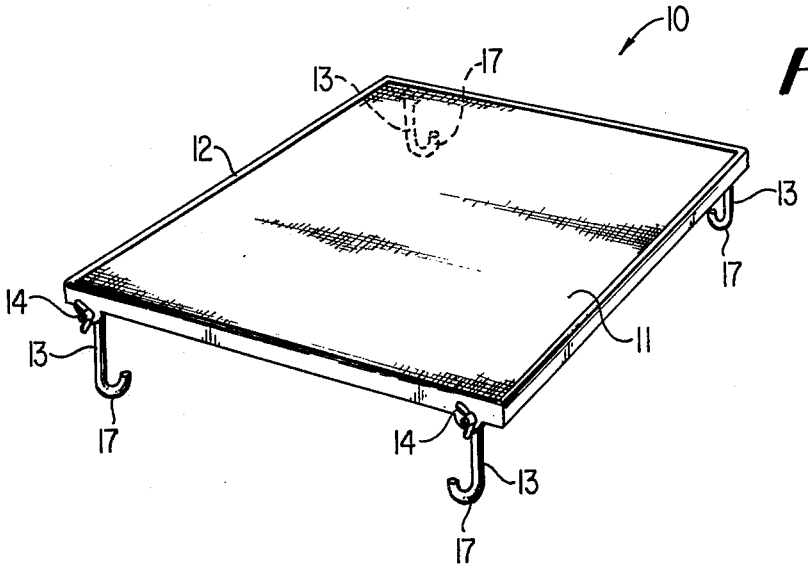
FIG. 1 is a perspective view of the screen device of the present invention.
Figure 3:
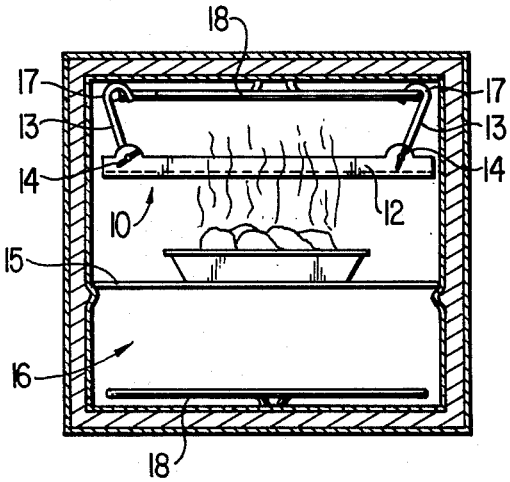
FIG. 3 is a side elevational view of an electric stove oven, showing the screen device of FIG. 1 attached to the broiler coils in the electric oven.
Figure 2:
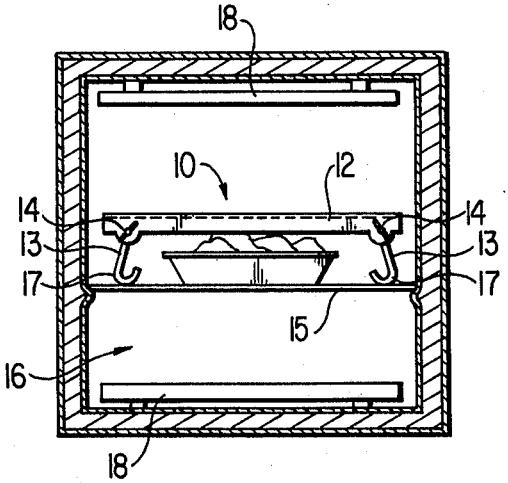
FIG. 2 is a side elevational view of a stove oven, showing the screen device of FIG. 1 installed on a rack within the oven.

In the embodiment of the present invention as illustrated in FIGS. 1 through 3, there is shown a screen device 10 which includes a flat screen member 11 of a fine mesh material, said member 11 being enclosed and supported around its periphery by a rigid frame 12. Each component of the present device 10 should be constructed of a durable, heat resistant material, such as a metal which can withstand oven temperatures, as well as contact with the heating elements within the oven. The screen 11 may be attached to the frame 12 by any suitable means, such as welding.

Adjacent each corner of the frame 12, there is provided a leg member 13 which is pivotally attached to the frame 12 of the screen device 10. The pivotal attachment of each leg member 13 to the frame 12 may be accomplished by means of a pin, rivet, nut and bolt, wing nut 14 or other suitable means which allows each leg 13 to be adjusted from a position in which the leg 13 is essentially perpendicular to the screen member 11 to a position in which the leg 13 is essentially parallel to and in the same plane with the screen member 11, and with the legs 13 retaining their set position sufficiently to support the weight of the screen device 10 in any of such positions or in an intervening position between the perpendicular and parallel positions. Such retention of the present position may be obtained, for example, by insuring that there is sufficient frictional engagement between the pin or rivet 14 and adjacent frame 12 with the respective leg 13.

The hinged effect created by the pins 14 allows the legs 13 to be manually adjusted in or out and thus raise or lower the screen 11 when the extreme ends of the legs 13 are resting on a tray or rack 15 within the oven 16, as shown in FIG. 2. As an example of dimensions which may be employed, good results have been obtained in various ovens with a screen device 10 having a length of about 13 inches and a width of about 12 inches, and with the legs being about 4 inches in length. The screen 11 should have a mesh size which will be sufficiently fine to trap grease which is splattered from food being broiled. As an example, a screen 11 having a mesh number of 30 × 30 may be employed.

An additional feature provided in the leg members 13 is the curved or U-shaped portion 17 on the bottom of each leg 13. This curved or U-shaped portion allows the device 10 to be utilized in an upside down or inverted position so that the device 10 may be directly attached to an allowed to hang from the broiler coils 18 in the upper portion of an electric oven 16 by means of the legs 13, as shown in FIG. 3.

The screen device 10 of the present invention provides an inexpensive and efficient means of preventing grease from splattering up to the flame or broiler coils of the oven as is often the case when broiling food. Furthermore, the screen device of the present invention requires a minimum amount of space in order to obtain these advantages. As previously described, the present screen device may be positioned on a rack or tray within any oven construction, such as a gas or electric oven, and with the food to be broiled located beneath the screen. In addition, the screen device may be attached directly to the overhead heating coils, in the case of an electric oven, again being situated between the coils and the food to be broiled, and thus performing a similar screening function from this location. In either case, sufficient space is provided between the screen 10 and the food so that heat convection and radiation may easily reach the food.

It is thought that the invention and many of its attendant advantages will be understood from the foregoing description, and it will be apparent that various changes may be made in the form, construction and arrangement of the parts without departing from the spirit and scope of the invention or sacrificing its material advantages, the forms hereinbefore described being merely the preferred embodiments thereof.

It is claimed:

1. A screen device for use in preventing grease from splattering within a stove oven, comprising:

a screen member in sheet form, said screen member having pivotally attached thereto a plurality of leg members each of which is pivotable about its point of attachment to the screen member from a position in which each leg member is essentially perpendicular to said screen member to a position in which said leg member is essentially parallel to and in the same plane with said screen member, each of said leg members having a U-shaped portion at the outer end thereof, said U-shaped end portion providing for said end portion to rest upon a rack within said oven or to support the screen in an inverted position from the electric coils in the upper portion of an electric oven.

2. The screen device of claim 1 wherein a frame member is attached to said screen member so as to extend around the periphery of said screen member and wherein said leg members are attached to said frame member.

3. The screen device of claim 2 wherein said frame member is in the shape of a square or rectangle, and wherein one leg member is attached to each corner thereof.

* * * * *